United States Patent [19]

Dickinson et al.

[11] Patent Number: 5,002,137

[45] Date of Patent: Mar. 26, 1991

[54] MOLING SYSTEM

[75] Inventors: Alan J. Dickinson, Kirby in Ashfield; Peter Ward, Cramlington, both of England

[73] Assignee: British Gas plc, London, England

[21] Appl. No.: 399,876

[22] Filed: Aug. 29, 1989

[30] Foreign Application Priority Data

Sep. 2, 1988 [GB] United Kingdom ..... 8820767
Oct. 31, 1988 [GB] United Kingdom ..... 8825393

[51] Int. Cl.[5] ..... E21B 7/04; E21B 47/024

[52] U.S. Cl. ..... 175/19; 175/45; 175/73; 324/346

[58] Field of Search ..... 175/19, 45, 61, 73, 175/75; 324/346, 326

[56] References Cited

U.S. PATENT DOCUMENTS

| | | | |
|---|---|---|---|
| 3,406,766 | 10/1968 | Henderson | 175/61 |
| 3,525,405 | 8/1970 | Coyne et al. | 175/19 |
| 3,589,454 | 6/1971 | Coyne | 175/61 X |
| 4,621,698 | 11/1986 | Pittard et al. | 175/19 X |
| 4,646,277 | 2/1987 | Bridges et al. | 324/346 X |
| 4,791,373 | 12/1988 | Kuckes | 175/45 X |
| 4,867,255 | 9/1989 | Baker et al. | 175/61 |
| 4,875,014 | 10/1989 | Roberts et al. | 175/45 X |
| 4,881,083 | 11/1989 | Chan et al. | 175/45 |

FOREIGN PATENT DOCUMENTS

| | | | |
|---|---|---|---|
| 246886 | 11/1987 | European Pat. Off. | 175/61 |
| 247767 | 12/1987 | European Pat. Off. . | |
| 266484 | 11/1987 | Japan | 324/346 |
| 1342475 | 1/1974 | United Kingdom | 175/45 |
| 2175096 | 11/1986 | United Kingdom . | |
| 2197078 | 5/1988 | United Kingdom . | |

*Primary Examiner*—Hoang C. Dang
*Attorney, Agent, or Firm*—Larson and Taylor

[57] ABSTRACT

A percussive-action mole 10 is energized by compressed air supplied through hollow rods 36 in a string 12 connected to the mole. A hydraulic motor 18 rotates the string and mole. The mole head 30 has a slant face 32 and a transverse permanent magnet 34. After each new rod is added to the string, the air is stopped to halt the mole which continues to be rotated. The field fluctuations from the magnet are detected by a magnetometer 24 using its probe at three positions 50, 52, 54 determiend by a triangular frame 22 placed flat on the ground. Calculations using the three readings each representing the distance of the magnet from the respective position on the frame enable the position and depth of the magnet to be determined. After completion, the passage 38 can be reamed to larger diameter to receive a gas pipe or other service.

12 Claims, 7 Drawing Sheets

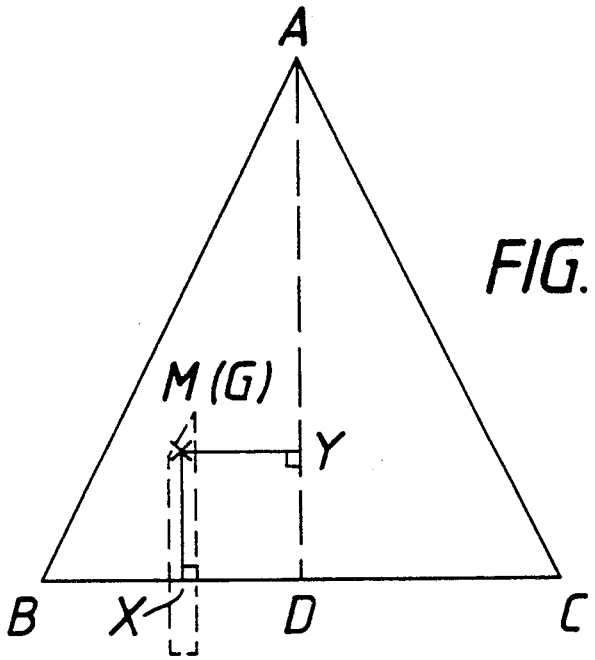
FIG. 2.
FIG. 3.
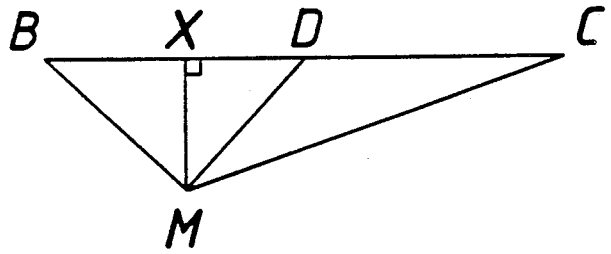
FIG. 4.
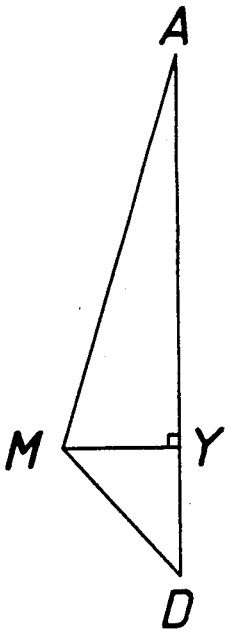

MOLING SYSTEM

The invention relates to moling systems, particularly though not exclusively systems applicable to the installation of gas pipes or other services in the ground.

It has been proposed in European patent application publication No. 247767 to connect a percussive mole to the leading end of a drill pipe. The mole has a slant face at its leading end and a turning couple acts on the mole in a plane normal to the slant face. The drill pipe is advanced as the mole advances. The direction of advance of the mole can thus be kept constant by rotating the drill pipe, which rotates the mole and the slant face about the central longitudinal axis of the mole. The direction of advance is changed by ceasing rotation and continuing advance of the mole.

It has been proposed in GB patent application publication No. 2197078A to provide a mole with sequentially-energised coils to generate a moving electromagnetic field which can be detected by a remote receiver to derive an indication of the position of the mole relative to the receiver and of roll, pitch and yaw of the mole.

It has been proposed in GB patent application publication No. 2175096A to provide a mole with coils wound on ferromagnetic cores to respond as receivers to a gyrating magnetic field produced by a remote elongated ferromagnetic transmitter element rotating relatively to a coil energised with alternating current. The position of the mole relative to the transmitter coil and element assembly, and the roll and pitch or yaw of the mole can be determined by comparison of the transmitted and received signals.

It has been proposed in U.S. patent specification No. 4621698 to provide a mole with two coils, one aligned with the roll axis of the mole, extending in the lengthwise direction of the mole, and the other transverse thereto. The coils are intermittently excited by low frequency current so as to produce corresponding magnetic fields. The magnetic fields are detected by crossed coils positioned in a pit excavated in the ground. The crossed coils intersect generally on the boresite axis. Outputs from the coils can be used to determine the angular position of the mole about the roll axis and the angular position of the roll axis in relation to the horizontal and vertical direction.

A moling system according to the present invention comprises a mole having a slant face at the leading end of the mole and means for obtaining indications representative of the plan and depth position of the mole and the angular position of the mole about a roll axis extending lengthwise of the mole, said mole comprising magnet means having its magnetic axis transverse to said roll axis and producing a magnetic field extending away from the mole and said means comprising magnetometer means operable in response to fluctuations of said magnetic field due to rotation of said mole about said roll axis to provide said indications representative of said angular position of the mole.

According to one preferred form of system, said magnetometer means comprise two magnetometer detectors one with its sensitive axis horizontal and the other with its sensitive axis vertical, the outputs from the detectors being passed to filter and conditioning means and then combined in a resolver which drives a magnet coupled to a pointer indicating the angular position of the mole about said roll axis.

In another preferred form of the method, the plan position and depth of the mole are determined using a reference device providing detector positions in a predetermined relationship and detector means operable at each of said detector positions in response to fluctuations of said magnetic field due to rotation of said magnet means with said mole about said roll axis to provide an indication at each detector position representative of the distance of said magnet means from said detector position.

Preferably, said detector means are magnetometers which at each of said detector positions provides indications of the amplitude of the magnetic field, the peak amplitude of which is representative of said distance, and the amplitude of the fluctuation and the direction of the change of the amplitude at any time are representative of the angular position of the mole about its roll axis.

Preferably, said means for obtaining indications comprise transmitter means in the mole operable to emit an alternating electro-magnetic field and receiver means operable to detect said alternating field to obtain indications representative of the plan and depth of the mole.

Embodiments of a moling system and preferred ways of using it to perform methods of moling will now be described by way of example with reference to the accompanying drawings, in which:

FIG. 2 is a diagrammatic plan showing a triangular reference device position about ground over a mole below ground;

FIGS. 3 and 4 are diagrams showing a triangle made up of one side of the reference device shown in FIG. 2 and two sides having lengths representing the distances between the magnet means in the mole and two detector positions one at each end of the side of the reference device;

Figure 1:
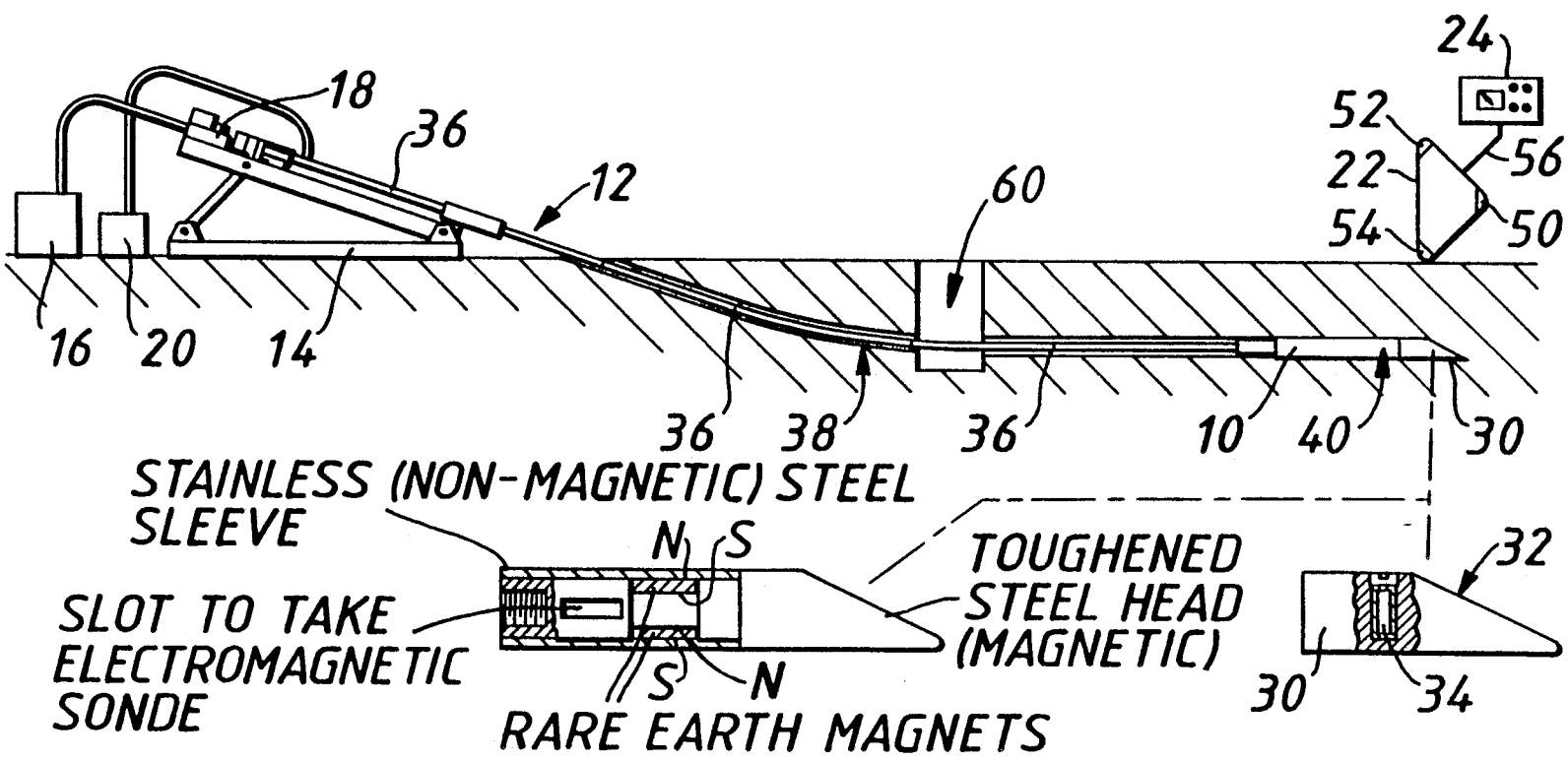
FIG. 1 is a diagrammatic longitudinal, vertical section through the ground showing the system in use.

The moling system shown in FIG. 1 consists of the following principal components: a pneumatically operable percussive mole 10; a string 12 of hollow drill rods connected end-to-end; a launching frame 14; a hydraulic power pack 16 supplying a hydraulic motor 18 on the frame 14 arranged to rotate the string 12; a source 20 of compressed air to power the mole 10; a triangular reference device 22 normally positioned flat on the ground but shown vertical for clarity; three magnetometer detectors 50,52,54 one at each corner of the reference device; and signal conditioning and display device 24.

FIG. 1 includes an enlarged detail showing the head 30 of the mole 10. The head 30 is of stainless steel and has a slant face 32. The head 30 has a transverse bore containing magnetic means in the form of a bar magnet 34; alternatively the magnet means are two thin section, rare earth magnets mounted in recesses on either side of the mole head; alternatively the magnet means is an electromagnet.

The string 12 is shown containing three rods 36 and the leading rod is connected to the trailing end of the mole 10. Typically, each rod 36 is 1.5 meters long.

The system is, for example, used to form a pilot passage 38, typically of 50 millimeters diameter, which would subsequently be reamed out to a larger diameter to receive a gas distribution pipe, for example of 125 mm outside diameter.

The mole 10 displaces earth as it advances under the precussive action of an internal hammer driven by pneumatic pressure. The slant face 32 on the head 30 of the mole gives rise to a transverse reaction from the earth which causes the path of the mole to curve in the direction opposite to that in which the face is directed. With the mole positioned as shown in FIG. 1 the path of the mole would curve downwardly, assuming the mole did not rotate about its roll axis 40 which extends in the lengthwise direction of the mole. In order to maintain the mole on a generally straight path the hydraulic motor 18 is operated to rotate the string 12 as the mole advances. The mole's path is then a corkscrew-shaped path of very small radius and approximates to a straight path. The pilot passage 38 shown in FIG. 1 is formed initially as the mole 10 is launched from the frame 14 into the ground at a small angle to the horizontal. Then, the mole's path is made to curve towards horizontal by setting the mole's angular position about its roll axis so that the slant face 32 faces downwardly.

As the mole progresses, it is necessary to monitor the mole's position beneath the ground in both the horizontal and the vertical planes. It is also necessary to monitor the mole's angular position about its roll axis 40. Such monitoring is performed using the reference device 22 and signal conditioning and display means 24.

The reference device 22 is preferably for example a frame in the form of an isosceles triangle having two equal sides, which provides three detector, positions 50,52,54 at which magnetometer detectors are positioned. The detectors are connected by a lead 56 to the signal conditioning and display unit 24.

The signal conditioning and display unit has a meter with a pointer which responds to the fluctuating magnetic field, and a means of capturing and displaying on a digital meter the value of the peak amplitude signal from each of the three detectors.

When the mole rotates about its roll axis, typically at between 20 and 60 revolutions per minute for example, the rotation of the magnet 34 causes fluctuation of the magnetic field about ground.

The response of the magnetometer means to that fluctuation is super-imposed on the effect of the earth's field. The needle on the magnetometer unit 24 oscillates about zero, owing to the earth's and other stray magnetic fields being compensated for either by electronic means (e.g. AC coupling) or by magnetic means. The peak-to-peak reading from each sensor is a measure of the distance of the magnetometer sensor from the magnet 34.

For each revolution of the mole about its roll axis 40, the needle travels from full left to full right and back to full left deflection. The direction of travel of the needle as well as its position can thus indicate the angular sense of rotation of the mole and can be used to set the angular position of the slant face 32 about the roll axis 40.

In monitoring the progress of the mole, the magnetometer means are used to obtain, for each of successive locations of the mole 10, a group of three peak amplitude readings. Each such location is reached by the mole after the advance for a given rod 36 has been completed. In other words, those locations occur every 1.5 meters. At each location, the forward progression of the mole is temporarily halted but the string 12 and the mole are rotated by the motor 18. The frame 22 is placed flat on the ground over the approximately known path of the mole with the apex of the triangle (i.e. the detection position 50) pointing in the approximate direction of advance of the mole.

For each location of the mole, the group of three readings is used to calculate the depth, the longitudinal position and plan position of the magnet 34 as will be explained next, with reference to FIGS. 2, 3 and 4.

In FIG. 2, the three corners A,B,C of the triangular frame correspond to the detector positions 50,52,54 respectively. The point G is in the plane of the frame and vertically above the magnet position M. The triangular frame is constructed in the form of an isosceles triangle with the equal sides extending from the apex that points in the direction of moling. For the system described here, the lengths of the equal sides are chosen so that the length of the base is 0.5 m and the distance from the base to the apex is 0.5 m. Whilst the calculations which follow will be valid for any isosceles triangle, the accuracy of the calculation of mole position will depend on the detector spacing and the depth of the mole. The dimensions of the triangular frame are a compromise between location accuracy and a convenient size for use of the detector frame.

In FIGS. 2 and 3, position D is the mid-point of the line BC.

In FIG. 3, M is the position of the mole head and a perpendicular from the mole (M) to the base line (BC) intersects at point X.

In FIG. 4, the line AD is the centre line of the detector frame and this line should be aligned with the intended path of the mole (i.e. the target line). Position Y is the intersection between the centre line of the frame (AD) and the perpendicular constructed from this line to the mole head.

At each location, the peak output from the three magnetometer detectors at positions A, B and C is a function of the distances of those positions from the magnet at the point M. In other words the distances AM, BM and CM can be determined by calculation from the detector outputs using equation 1:

$$\log S = (-k1 \log V) + k2 \cos P - k3 \qquad \text{EQU. 1}$$

where S is the distance of the magnet from the detector, $k_1$, $k_2$, $k_3$ are constants, V is the peak output signal from the detector and P is the out-of-plane angle, i.e., the angle between the plane of rotation of the magnet and the line joining the magnet to the detector.

It can be shown that for detectors at positions B and C, the out-of-plane angle P is given by EQU 2:

$$P = \text{arc tangent } GX/GM \qquad \text{EQU 2}$$

where $GX^2 = (BM^2 - BX^2 - GM^2)$ and GM is the vertical depth of the magnet.

For the detector at position A, the out-of-plane angle is given by equation 3:

$$P = \text{arc tangent } (AD - YD)/GM. \qquad \text{EQU.3.}$$

The value of the distance S from the magnet to a detector (corresponding to the distances AM, BM, CM) is calculated using as a first approximation an out-of-plane angle P=0. From these first approximations a first estimate of the location of the magnet can be calculated in terms of XM, YM and GM. From the first estimate of the position of the magnet, the out-of-plane angle can be derived approximately using either equations 2 or 3. The magnet position can then be recalculated and a better estimate of angle P obtained. Three itterations give a sufficiently accurate estimate of the magnet position.

The calculation of depth plan and longitudinal position is split into three parts. The first part calculates the sideways plan position (i.e. the X value) using the equation 4:

$$BX=(BC^2+BM^2-CM^2)/2BC \qquad \text{EQU. 4}$$

where BC is known from the dimensions of the detector frame and BM and CM are calculated from Equation 1.

The second part calculates the longitudinal position (i.e. the Y value).

To determine the Y position, the magnetometer outputs from the detectors at positions B and C are combined to establish an estimate of the signal that would be seen by a detector at the mid point position D on the baseline, and then the estimated signal is used with the signal from the detector at the apex A to calculate the Y position.

To generate the signal from the imaginary sensor at D, first the distance from X to the magnet (XM) is calculated from equation 5:

$$XM^2=(BM^2-BX^2) \qquad \text{EQU. 5}$$

then the distance from D to the magnet is calculated using equation 6:

$$DM^2=(XM^2+DX^2) \qquad \text{EQU. 6}$$

then using the distance DM in equation 1, an estimate is made of the peak output voltage which would be produced by a detector at D. Finally, the distance DY (i.e. the Y position) is calculated from equation 7:

$$DY(AD^2+DM^2-AM^2)2AD( \qquad \text{EQU.7}$$

The third part of the process calculates the depth of the mole below the X,Y coordinate point (G) by calculating the distance from Y to the magnet YH using $$YM^2=(DM^2-DY^2)$$

and then calculating the vertical depth (GM) from $$GM^2=(YM^2-XD^2)$$

The various calculations are conveniently and quickly performed by a microcomputer using a relatively simple programme so that the position and depth of the mole can readily be made in the field as moling progresses without unduly delaying the moling procedure.

Alternatively the outputs from the three detectors can be passed directly into the microcomputer, increasing the speed of the system and reducing the chance of operator error.

FIG. 1 shows a small excavation 60 which is intended to allow, for example, a connection to be made into the gas pipe or other service which is installed either in the passage 38 or in a passage of larger diameter formed by reaming out the passage 38. The part of the passage 38 leading from the surface of the ground to the excavation 60 would not normally be required to receive a gas pipe or other service and functions purely as a pilot entry passage for the rod string 12 during moling.

Figure 5:
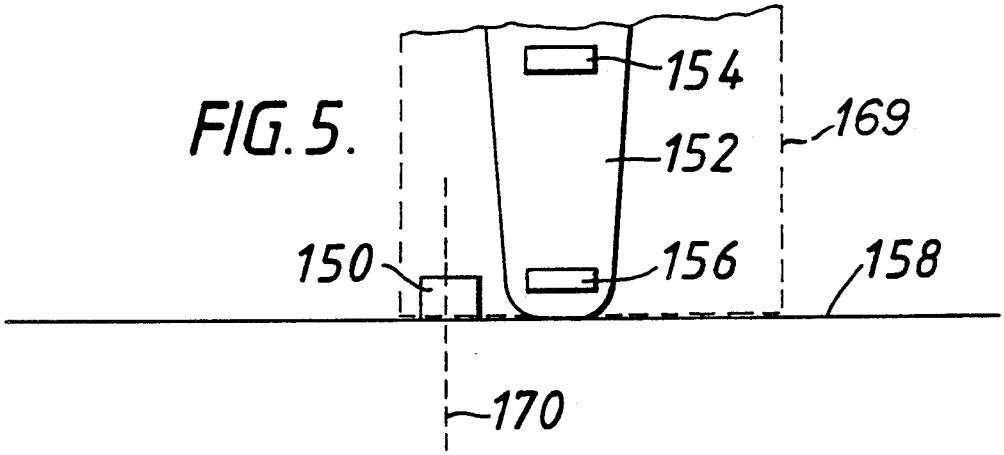
FIG. 5 is a diagrammatic vertical section through part of a second embodiment of system.
Figure 5:
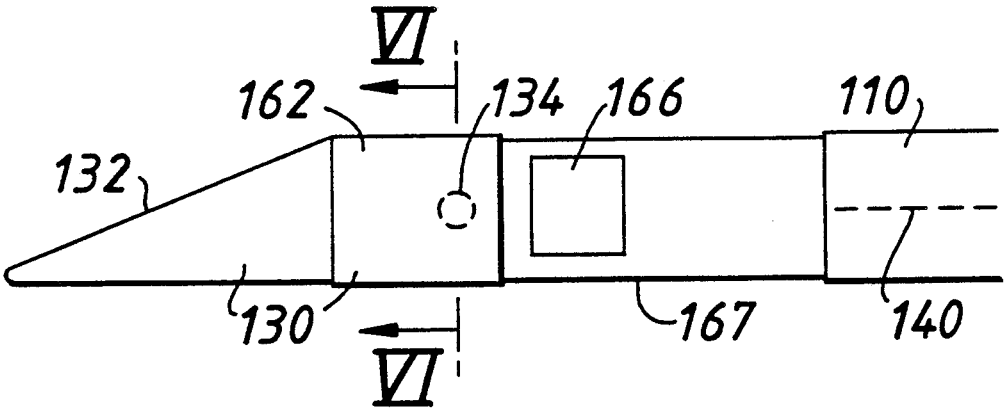
Figure 6:
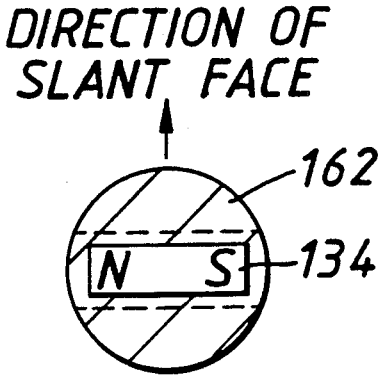
FIG. 6 is a section on the line VI—VI in FIG. 5.

FIGS. 5 and 6 show an alternative system in which the following features are shown:

Detector means 150, preferably a fluxgate magnetometer e.g. type LPM2 available from Thorn EMI Limited; further detector means 152, preferably a receiver unit type RD300 available from Radiodetection Limited having two solenoid coils 154,156 one above the other; the surface of the ground is shown at 158; the head 130 of the mole 110; the slant face 132 on the head 130 and the transverse bore containing the permanent magnet 134. The magnet 134 is preferably an Alnico alloy type available from Buck and Hickman. It is 30 millimeters long and 10 mm in diameter. it gives a peak field strength of 10 micro-tesla at 0.3 meter from the magnet. The magnetic axis is transverse to the roll axis 140 of the mole 110.

Alternatively rare earth type magnets can be used as in the configuration shown in FIG. 1. These give a peak field strength of 100 micro-tesla at 0.3 m from the magnet.

If the mole rotates at 20 revolutions per minute, the field varies effectively at the ground surface at 0.3 $H_z$.

The head 130 consists of two parts: the leading part of toughened steel providing the slant face 132 and a non-magnetic stainless steel carrier 162 for further detector means in the form of a sonde 166. The sonde 166 is preferably a re-packaged version of a small sonde available from Radiodetection Limited. The sonde 166 is located in a transverse slot in the carrier 162 and retained by a sleeve 167. The sonde 166 typically measures 40 mm×40 mm×13 mm and is supported by a rubber mounting to isolate it from impact forces. The sonde 166 contains integrally encapsulated rechargeable batteries and transmits an electromagnetic field at a preferred frequency of 33 kiloherz, though a range of 8–125 $kH_2$ is available. The transmitter is designed so that the field is uniform about the roll axis of the mole.

The magnetometer 150 and the receiver 152 preferably form a single transportable unit indicated at 169. The output from the coils 154, 156 is amplified, filtered to reduce interference, rectified and displayed on a moving coil meter. The detection range is better than 1.5 meter.

Figures 7, 8, 9, 10:
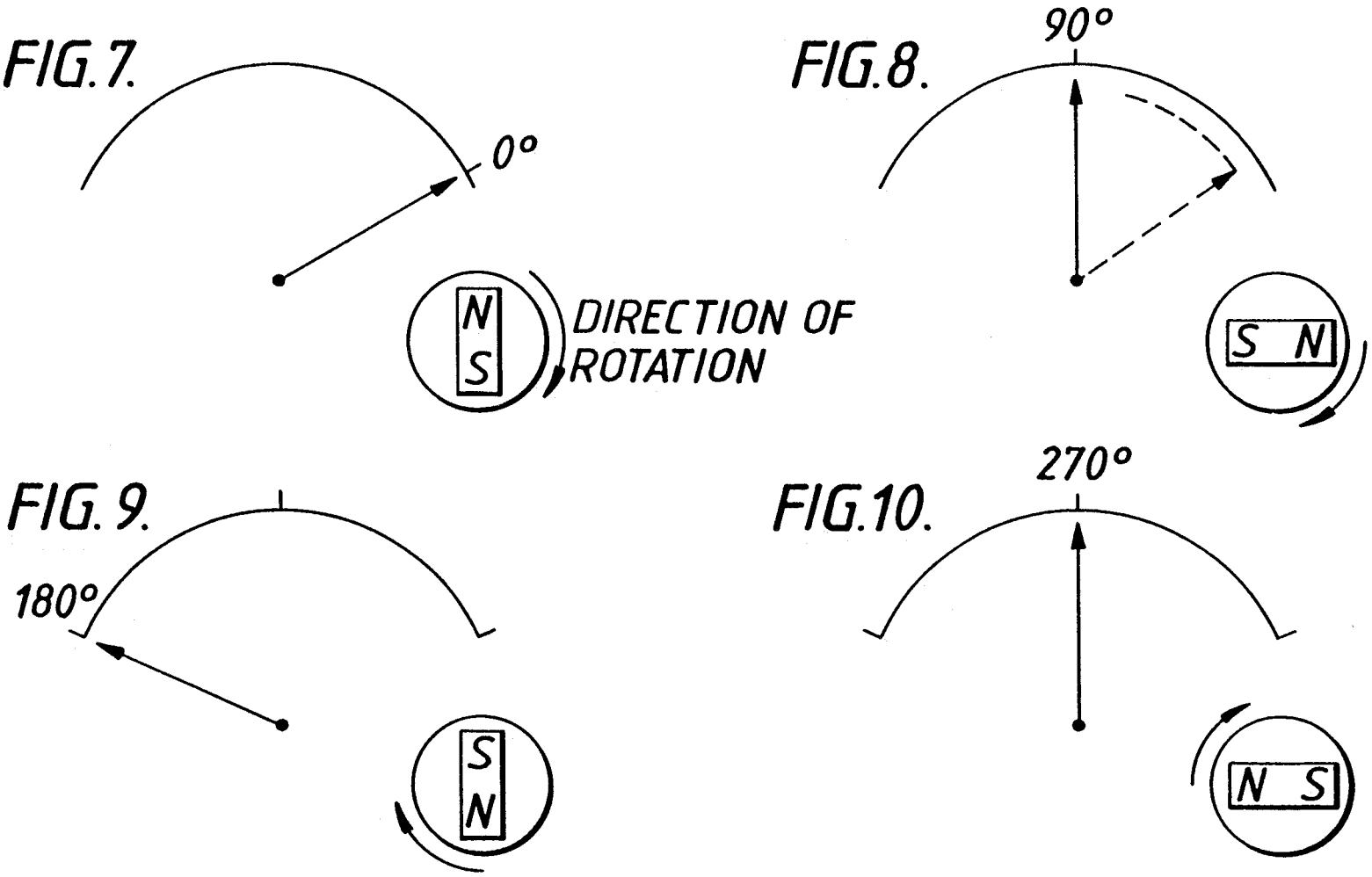
FIG. 7 to 10 show diagrammatically the variation in the output of the magnetometer with roll angle.

The sensitive axis 170 of the magnetometer 150 is arranged vertically. Peak positive response is obtained when the north pole of the magnet 134 is pointing vertically towards the magnetometer 150 and zero response is obtained when the axis of the magnet 134 is horizontal. FIGS. 7 to 10 show the meter outputs of the magnetometer 150 as the mole rotates through 360° about its roll axis. Starting at FIG. 7 with the magnet axis vertical and the north pole uppermost, the meter output is a positive, clockwise maximum corresponding to a starting angular position of 0°. FIG. 8 shows the meter output at midscale i.e. zero corresponding to 90° rotation. FIG. 9 shows meter output at negative, anti-clockwise maximum corresponding to 180° rotation. FIG. 10 shows the meter at mid-scale, i.e. zero corresponding to 270° rotation of the mole.

The output from the magnetometer is amplified with an AC coupled amplifier with a low frequency cut-off at 0.03 $H_z$. The AC coupling removes the large offset caused by the vertical component of the earth's magnetic field. The amplifier has adjustable gain and the output is fed to the centre-zero moving coil meter which gives the scale indications shown in FIGS. 7 to 10.

As the mole rotates the meter output fluctuates as already explained, the needle oscillating about the centre zero. The magnitude of the peak response depends on the distance of the magnet 134 from the magnetometer and the gain setting of the amplifier. The gain setting is adjusted, once the oscillations have begun, until the meter needle travels from the full anti-clockwise position to the full clockwise position. By noting the position and direction of travel of the needle, the instantaneous angular position of the slant face 132 can be determined. The rotation of the mole can be halted with the slant face 132 in a predetermined orientation so that subsequent advance of the mole without rotation effects a desired change in the direction of advance.

The plan position of the mole is determined by sweeping the transportable unit across the ground. The field strength of the electromagnetic field emitted by the sonde 166 varies with distance so when a maximum output is observed from the receiver 152, the receiver is known to be above the mole. The two coils 154, 156 enable the field strength and the field gradient to be measured which enables the depth of the mole to be determined.

The determination of the plan position depth and angular position of the mole is carried out at successive intervals, preferably after each new rod (corresponding rods 36 of FIG. 1) is added. During the determination the air supply to the mole is discontinued so that the mole is not advancing. However, the motor (corresponding to motor 18 of FIG. 1) continues to run so that the mole is still rotating about its roll axis 140.

Once the determination has been completed, the mole either continues as before or, if a correction is required in its direction of advance, the mole is advanced without rotation, the mole's angular position about the roll axis 140 having been set so that the slant face is oriented to produce a desired correction to the line of advance. The amount of correction achieved is checked at the next determination of position and if necessary, further advance without rotation is effected, and so on.

Figure 11:
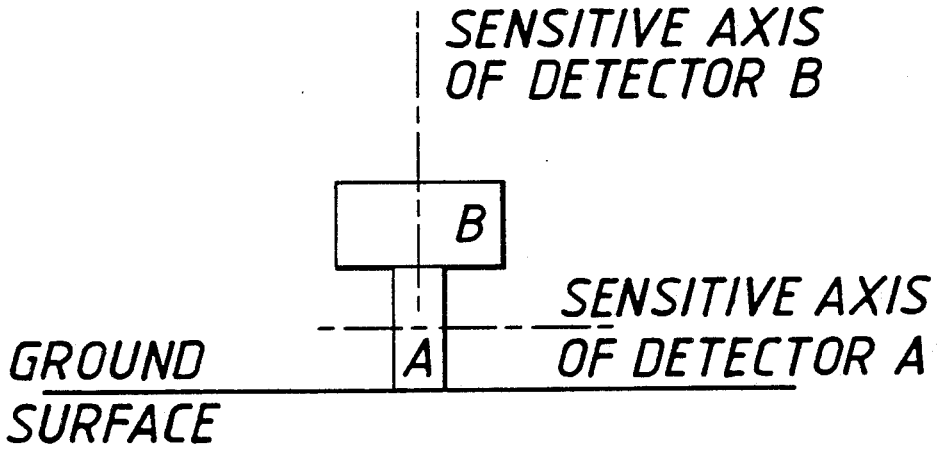
FIG. 11(*a*) is a diagrammatic vertical section through part of a third embodiment of system and FIG. 11(*b*) shows diagrammatically the direction of rotation of the mole head.
Figure 11:
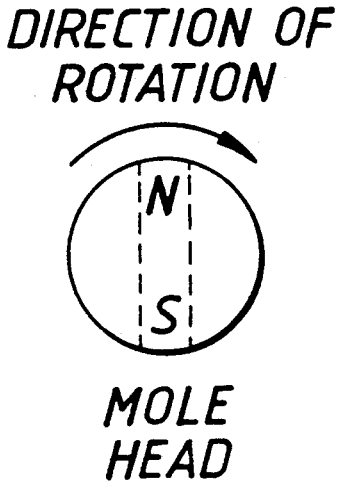

Another embodiment of system is shown in FIGS. 11(*a*), 11(*b*), 12 and 13 in which two magnetometer detectors replace the single magnetometer detector shown in FIG. 5. The receiver unit 52 would, of course, still be used.

This embodiment can also be used in the system described with reference to FIGS. 1 to 4 by using four magnetometer detectors there being two magnetometer detectors at one of the corners of the triangular frame. The two magnetometer detectors are placed close together directly above the magnet position. The two detectors are arranged with the sensitive axis of one in a vertical direction and the sensitive axis of the other in a horizontal direction in the plane of rotation of the magnet.

As the mole head (and thus the magnet) rotates the signal from both detectors will be sinusoidal but because of the different orientation of the two detectors there will be a 90° phase difference between the outputs so that one detector output will describe a sine function and the other detector output will describe a cosine function.

The signals from the two detectors also contain a D.C. component resulting from the effect of the earth's magnetic field and other magnetised objects in the vicinity. The signals are therefore passed to a signal conditioning unit which filters the D.C. component leaving just the sinusoidal components of the two signals. The signals are then passed to a display device which consists of a D.C. Resolver which drives a pointer round a circular scale.

FIGS. 11(*a*) and 11(*b*) show the arrangement of the detection in relation to the mole head. The view of the mole head in FIG. 11(*a*) is along the longitudinal axis of the mole with the magnetic axis transverse. As the mole head rotates, the magnet generates a varying magnetic field at the ground surface. If the speed of rotation is reasonably constant then the magnetic field at the ground surface varies sinusoidally.

Detector B is arranged with its sensitive axis in a vertical direction so that as the magnet rotates, the output from the detector has a peak positive value when the north pole of the magnet points towards the sensor and a peak negative value when the south pole of the magnet points towards the sensor.

Figure 12:
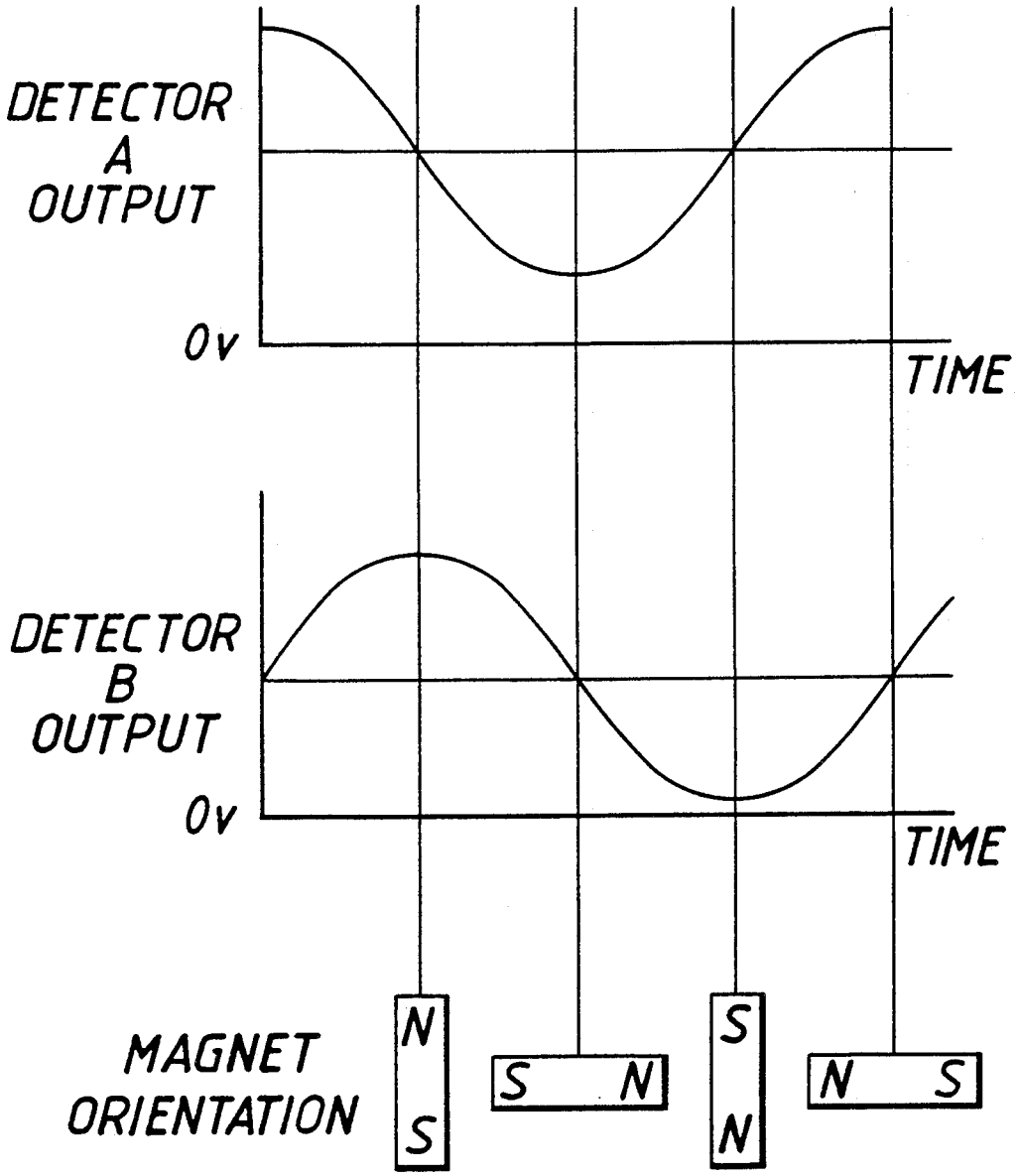
FIG. 12 shows magnetometer outputs for different roll angles for the system of FIG. 11.

In addition to this varying field the detector will also respond to the vertical component of the earth's magnetic field. The resultant output from the detector is shown in FIG. 12.

Detector A is arranged with its sensitive axis in a horizontal direction in the plane of rotation of the magnet. As the head rotates the output from this detector has a peak positive value when the magnet is horizontal with its north pole pointing to the left, and a peak negative value when the south pole points to the left. In addition to the varying field the detector will also respond to the horizontal component of the earth's field. The resultant output of detector A is shown in FIG. 12.

Figure 13:
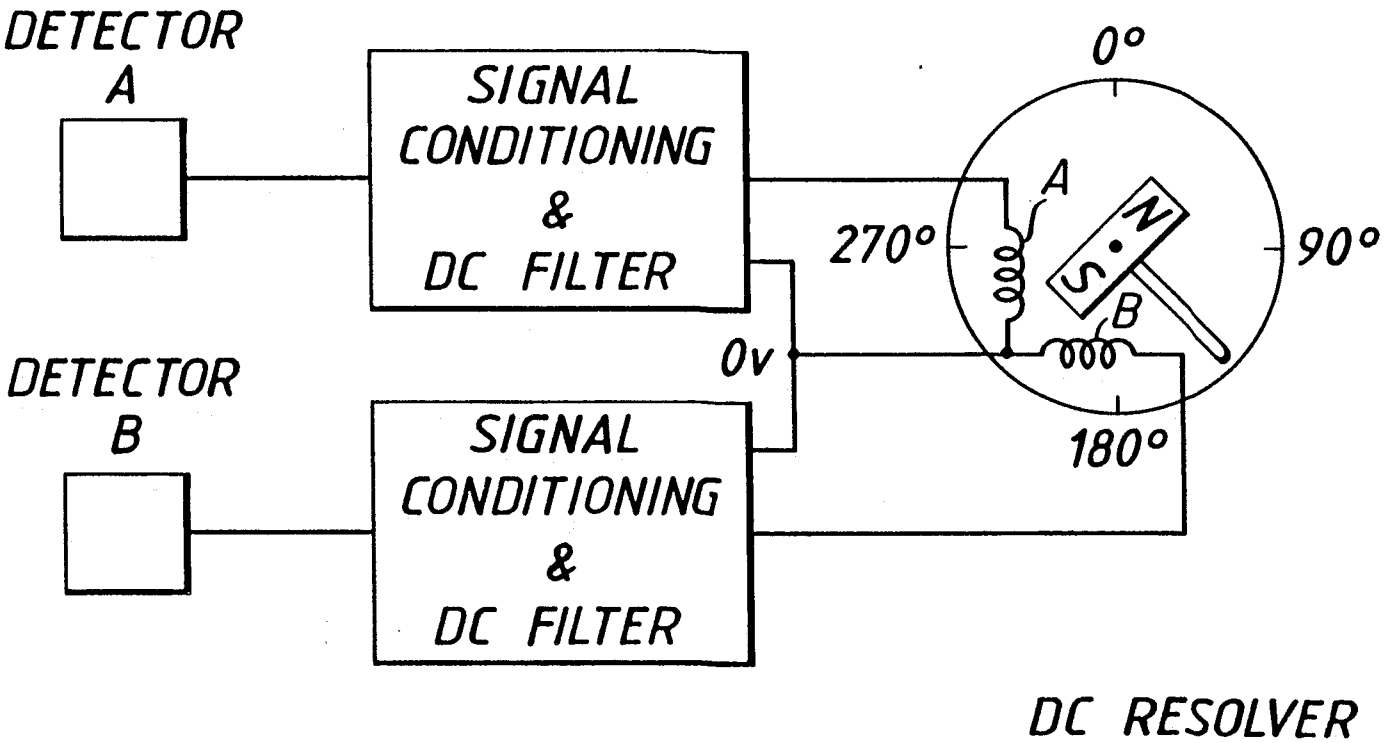
FIG. 13 shows the magnetometer detectors of the system shown in FIGS. 11(*a*) and 11(*b*).

As shown in FIG. 13, the output from detectors A and B are passed to two signal conditioning units which filter out the DC component and then amplify the signal to the correct level to drive the DC resolver.

The DC resolver comprises two coils, A and B arranged at right angles with a magnet pivoted about its centre. Coil A is driven by the cosine signal from detector A and coil B is driven by the sine signal from detector B. Each coil generates a magnetic field proportional to its excitation current and the resultant field is the algebraic sum of the fields generated by A and B.

If the peak amplitude of the fields generated by coils A and B are the same then the resultant is a constant amplitude magnetic vector rotating at a velocity determined by the period of the excitation signals. The rotating magnetic vector thus has the effect of causing the pivoted magnet to rotate and mimic the rotation of the magnet in the head of the mole. A pointer is fixed to the magnet in the Resolver and the circular scale indicates the angular position of the mole head. Thus, by stopping rotation when the head is in a desired position the mole's course can be corrected as required.

The advantages of this technique are that:

1. The pointer gives a clear visual indication of the orientation of the mole head.

2. The operation of the DC resolver depends on the relative amplitudes of the signals applied to coils A and B which are affected equally by changes in depth. There is therefore less need for the operator to accurately adjust the signal amplitude in order to get an accurate indication of roll angle.

We claim:

1. A moling system comprising a mole having a slant face at the leading end of the mole and means for obtaining indications representative of the plan and depth position of the mole and the angular position of the mole about a roll axis extending lengthwise of the mole, said mole comprising permanent magnet means having its magnetic axis transverse to said roll axis and producing a magnetic field extending away from the mole and penetrating into the ground surface in a zone about the mole and said indications obtaining means comprising magnetometer means transversable over the ground surface following the mole and operable in response to fluctuations of said magnetic field above the ground surface due to rotation of said mole about said roll axis to provide said indications representative of said angular position of the mole.

2. A system according to claim 1, said magnetometer means comprising two magnetometer detectors one with its sensitive axis horizontal and the other with its sensitive axis vertical, the outputs from the detectors being passed to filter and conditioning means and then combined in a resolver which drives a magnet coupled to a pointer to indicate the angular position of the mole about said roll axis.

3. A moling system according to claim 1 comprising a reference device providing detector positions in a predetermined relationship and detector means operable at each of said detector positions in response to fluctuations of said magnetic filed due to rotation of said magnet means with said mole about said roll axis to provide an indication at each detector position representative of the distance of said magnet means from said detector position.

4. A system according to claim 3, said detector means being magnetometers which at each of said detector positions provides indication of the amplitude of the magnetic field, the peak amplitude of which is representative of said distance, and the amplitude together with the direction of change of the amplitude of said indication is representative of the angular position of said mole about said roll axis.

5. A system according to claim 3 or claim 4 said reference device providing three detector positions in a predetermined triangular relationship.

6. A system according to claim 1 said means for obtaining indications comprising transmitter means in the mole operable to emit an alternating electro-magnetic field and receiver means operable to detect said alternating field to obtain indications representative of the plan and depth of the mole.

7. A moling system comprising a mole having a roll axis extending lengthwise of the mole and a slant face at the leading end of the mole, said mole further comprising permanent magnet means, comprising a single permanent magnet having its magnetic axis transverse to said roll axis, for producing a magnetic field extending away from the mole, and penetrating, in use, into the ground surface around the mole; means for rotating said mole so as to thereby cause rotation of said permanent magnet means around said roll axis; and measuring means for producing indications representative of the plan and depth position of the mole and the angular position of the mole about said roll axis, said measuring means comprising magnetometer means, traversable over the ground surface following the mole and responsive to fluctuations of said magnetic field above the ground surface due to rotation of said mole about said roll axis, for providing said indications representative of said angular position of the mole.

8. A system according to claim 7, wherein said magnetometer means comprises two magnetometer detectors, one with the sensitive axis horizontal and the other with the sensitive axis thereof vertical, for producing respective outputs; filter and conditioning means for receiving the outputs of said detectors and for producing first and second further outputs; and a resolver means for combining said first and second further outputs; and for driving a magnet coupled to a pointer to indicate the angular position of the mole about said roll axis.

9. A moling system according to claim 7, further comprising a reference device providing a plurality of detector positions in a predetermined relationship and detector means, operable at each of said detector positions in response to fluctuations of said magnetic field due to rotation of said permanent magnet means of said mole about said roll axis, for providing an indication at each detector position representative of the distance of said permanent magnet means from that detector position.

10. A system according to claim 9, wherein said detector means comprises a plurality of magnetometers for, at each of said detector positions, providing an indication of the amplitude of the magnetic field, the peak amplitude of said indication being representative of said distance, and the amplitude of said indication together with the direction of change of the amplitude of said indication being representative of the angular position of said mole about said roll axis.

11. A system according to claim 9 wherein said reference device provides three detector positions in a predetermined triangular relationship.

12. A system according to claim 7 wherein said measuring means comprises transmitter means in the mole for producing an alternating electro-magnetic field and receiver means for detecting said alternating field to obtain indications representative of the plan and depth of the mole.

* * * * *